United States Patent [19]

Pellerin de Beauvais

[11] Patent Number: 4,926,012

[45] Date of Patent: May 15, 1990

[54] MINIATURE ELECTRIC SWITCH DESIGNED TO BE USED IN PARTICULAR IN PRINTED CIRCUITS

[75] Inventor: Hugues Pellerin de Beauvais, Paris, France

[73] Assignee: Societe d'Etude et de Construction de Materiel Electronique, Cedex, France

[21] Appl. No.: 356,755

[22] Filed: May 25, 1989

[30] Foreign Application Priority Data

Jun. 1, 1988 [FR] France ..... 88 07309

[51] Int. Cl.[5] ..... H01H 15/00

[52] U.S. Cl. ..... 200/16 R; 200/16 D

[58] Field of Search ..... 200/16 D, 333, 334, 200/16 R, 308, 317

[56] References Cited

U.S. PATENT DOCUMENTS 3,974,346 8/1976 Keprda ..... 200/333 X
4,152,565 5/1979 Rose ..... 200/16 DX
4,168,404 9/1979 Lockard ..... 200/16 DX
4,628,166 12/1986 Bingo et al. ..... 200/16 DX

*Primary Examiner*—J. R. Scott
*Attorney, Agent, or Firm*—Sherman and Shalloway

[57] ABSTRACT

An electric switch having a body (1) of insulating material which contains at least one recess (2) into which enter the ends (3*a*, 4*a*) of at least two terminals (3,4) the opposite ends of which (3*b*,4*b*) project outside the body, and a switch mechanism comprising an electrically-conducting element (5) fitted so as to slide in the recess (2) between first and second stable positions. The switch is characterized in that the electrically-conducting element (5) comprises a stirrup having an elastic middle part (6), contact points (8) and upwardly extending arms (9) that extend towards the opening (10) of the recess (2), appearing in windows (15) defined in the opening (10) on either side of an insulating element (14) that retains the stirrup (5) in the recess (2), the arms (9) constituting structure for moving the stirrup (5) between first and second positions.

12 Claims, 2 Drawing Sheets

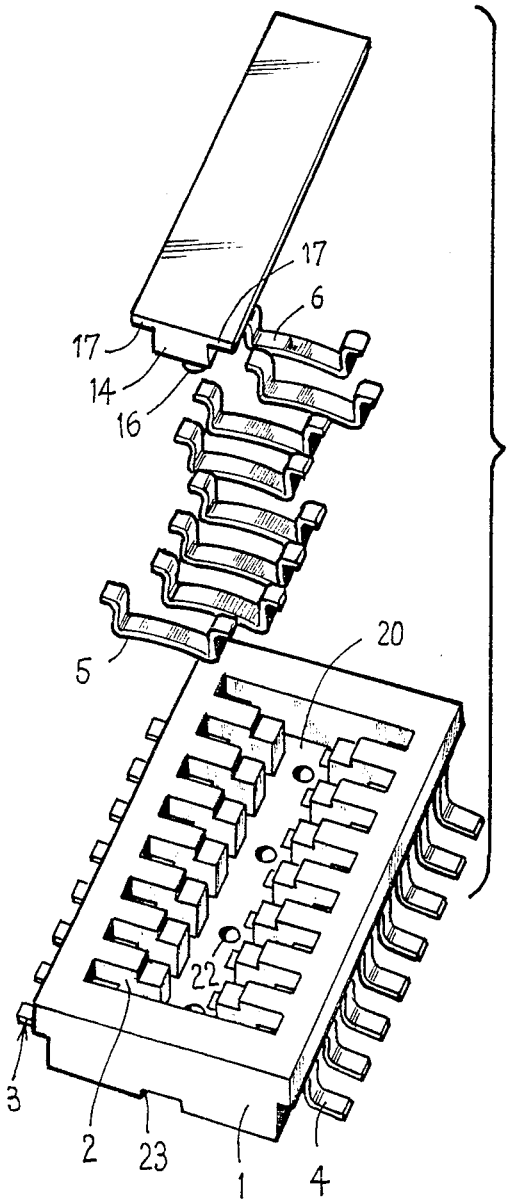
FIG. 1
FIG. 2
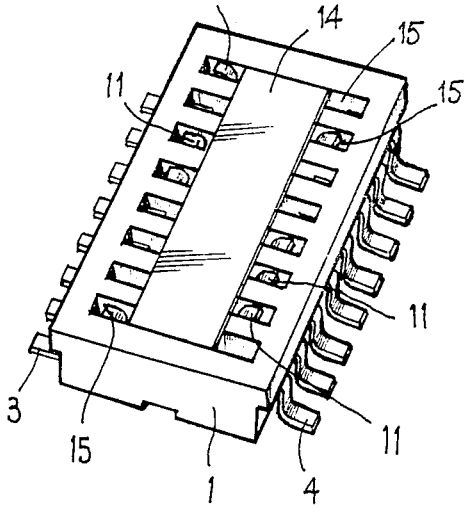

MINIATURE ELECTRIC SWITCH DESIGNED TO BE USED IN PARTICULAR IN PRINTED CIRCUITS

BACKGROUND OF THE INVENTION

The present invention relates to electric switches and more particularly to miniature switches designed to be fitted in printed circuits.

Miniature switches for printed circuits are known which have a body of insulating material inside which is positioned a switch mechanism, and designed to establish or cut an electrical link between connection terminals projecting outside the body and a part of insulating material for activating the switch mechanism.

Switches of the type described above are grouped in modules with several ways, for example eight, positioned in a parallel manner in a common insulating case of parallelepiped form.

In known switches of this type, the connection terminals generally project in relation to one of the main sides of the case and they are constituted by stems designed to be inserted in holes provided in the printed circuit board in order to be soldered to the corresponding conductors of the printed circuit.

Such switches lend themselves badly to the flat transfer technique which is more and more widely used for the manufacture of printed circuit boards.

In addition, due to the relatively large volume taken up by switch mechanisms and activation means, these switches are so bulky that on a printed circuit board they take up more and more space compared with that taken up by the integrated circuits, the size of which is getting smaller and smaller.

The invention therefore aims to remedy the above-named drawbacks of miniature switches of the prior art, by creating a switch which, being smaller than traditional switches, is particularly suited to the technique of fitting components on the surface of circuit boards designed to support them, and which lends itself particularly well to the flat transfer technique.

A subject of the invention is therefore an electric switch having a body of insulating material which contains at least one recess into which enter the ends of at least two connection terminals, the opposite ends of which project outside the said body and a switching mechanism having an electrically-conducting element fitted so as to slide in the recess between a first and second stable position, corresponding respectively to two states of the switch, characterized in that the electrically-conducting element is constituted by a stirrup of which a elastic middle part, curved away from the bottom of the recess, is in contact by its ends with the bottom into which enter the corresponding ends of the connection terminals, and of which the arms extend towards the opening of the recess of the body and appear in windows defined in the opening, on either side of an insulating element for retaining and pressing the stirrup against the bottom of the recess by acting on the curved elastic middle part of the stirrup, the arms of the stirrup constituting the means of moving the latter between the first and second positions.

BRIEF DESCRIPTION OF THE DRAWINGS

The invention will be better understood from the description which follows, given only as an example and with reference to the attached drawings, in which:

FIG. 1 is an exploded perspective view of the miniature switch according to the invention;

FIG. 2 is a perspective view of the switch of FIG. 1 in the assembled state;

DETAILED DESCRIPTION

The switch represented in FIG. 1 has a body 1 of insulating material of more or less parallelepiped form, in which are arranged, side by side, eight recesses 2 of generally rectangular form which extend crosswise to the longitudinal axis of the body.

Figure 3:
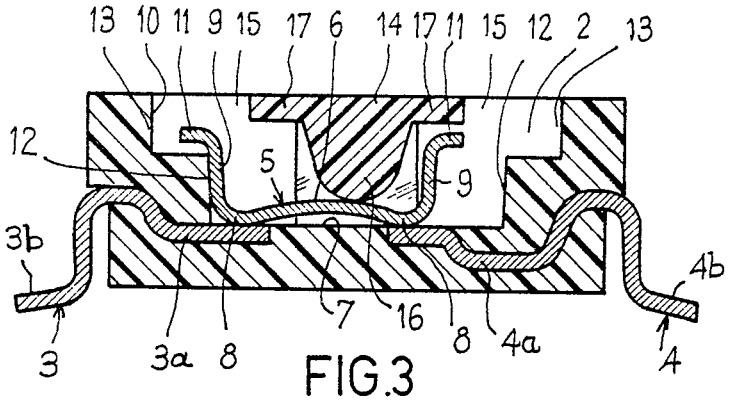
FIG. 3 is a cross-sectional view on a larger scale, of the switch of FIG. 2.

As can be seen from FIG. 3, the switch has two connection terminals 3,4 each having an end 3*a*,4*a* which extend into opposite ends of a corresponding recess 2, the other ends 3*b*,4*b* of the said terminals projecting outside the body 1 of the switch and being bent up to constitute the connection pads of the said switch. The shape of the pads 3*b*,4*b* is particularly well suited to the flat transfer technique.

In each of the recesses 2 is fitted a slidable electrically-conducting element 5 in the form of a stirrup. This element has an elastic middle part 6 curved away from the bottom 7 of the recess and is in contact by the ends 8 of the curved middle part 6 with the bottom 7 of the recess 2 and the ends 3*a*, 4*a* of the connection terminals 3 and 4.

The stirrup 5 has in addition two arms 9 more or less perpendicular to the middle part 6 and which extend towards the opening 10 of the recess 2. Each of these arms 9 is terminated by a tongue 11 bent at right-angles. The arms 9 of the stirrup 5 constitute the activating means of this stirrup to cause its translatory movement in the recess 2. The Applicant has noted that although the arms 9 of the stirrup 5 are electrically-conducting, their coming into contact with a tool held in an operator's hand does not cause any disturbance in a circuit of which the switch forms a part due to the extremely weak currents used in such circuits.

As represented in FIG. 3, each of the end walls of the recess 2 has a first part 12 forming an end-stop for the movement of the stirrup 5 and thus defining two stable positions for this stirrup corresponding to two states of the switch, and two sections 13 closer to the corresponding outer edges of the body 1, and which define, together with an insulating element 14 for retaining and pressing the stirrup 5 against the bottom 7 of the recess 2, windows 15 allowing access to the arms 9 of the stirrup in order to manoeuvre them.

The retaining element 14 is fitted in the center of the axial dimension of the recess 2 so that the windows 15 defined in this element and the opening 10 of the recess 2 are the same size. The retaining element 14 presses against the curved elastic middle part 6 of the stirrup 5 by a rib 16 which lightly compresses the curved middle part 6 and thus keeps the stirrup 5 against the bottom of the recess 2 so that when the stirrup occupies one of the two end positions defined by the end surfaces 12 of the recess 2, these positions, which each correspond to one state of the switch, are stable due to the slight force exerted by the rib 16 of the retaining element 14 on the elastic curved middle part 6.

The retaining element 14 includes in addition two edges 17 extending from the rib 16 in the axial direction o recess 2, and under which the tongues 11 of the arms 9 of the stirrup can in turn be concealed. Thus, for each position of the stirrup 5, only one of the arms 9 of the stirrup is visible through the corresponding window 15, so that the position of the switch can be seen immediately without ambiguity.

In FIGS. 1 and 2, there is represented a switch, according to the invention made with eight parallel switch elements positioned side by side in one case.

The recesses 2, in each of which is fitted a stirrup 5, are separated by walls with gaps in the middle to form a housing 20 into which is fitted a retaining element 14 common to all the stirrups and which has as many axial ribs 16 as the body has recesses, the said ribs being designed to keep under slight stress the curved elastic middle parts 6 of the stirrups 5 arranged in the respective recesses 2.

The ribs 16 are separated by support elements 16*a* for the retaining element 14 on the bottom of the housing 20, the said elements 16*a* being inserted in the gaps in the walls separating the recesses 2.

The retaining element 14 is inserted into the housing 20 so that its upper surface is flush with the surface of the body 1 opposite to the bottom 7 of the recess. The multi-elements switch in FIG. 1 is shown assembled in FIG. 2.

It can be seen from this Figure that, as previously indicated the state of the various elements of the switch is immediately observable through the windows 15 in which the tongues 11 of the activation arms of the stirrups 5 appear, the presence of such a tongue in a window 15 corresponding to the position of the element in question.

The retaining element 14 is fixed to the body 1 for example by soldering.

Figure 4:
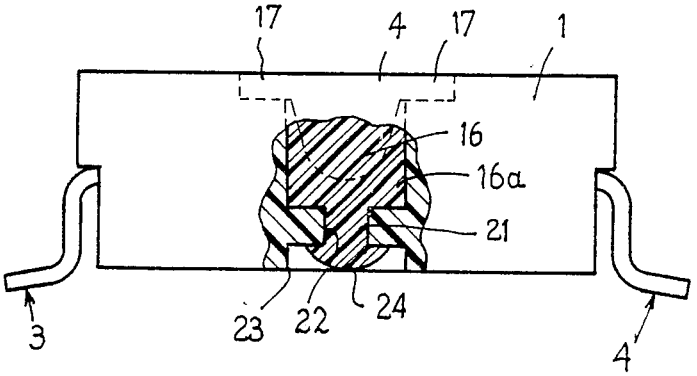
FIG. 4 is an end view, partially cut away, of the switch of FIG. 3.

For this purpose, as shown in FIG. 4, is has, evenly distributed along its length, stems 21 which depend from the support elements 16*a* and which are inserted into holes 22 arranged in the bottom of the body 1 and which emerge into an axial groove 23 of the outer wall of the bottom. Heads 24 are formed at the ends of the stems 21, for securing the element 14 in its housing 20.

It can also be seen in FIG. 2 that the upper surface of the body 1 of the switch is smooth and therefore lends itself particularly well to the application of an adhesive film to protect the windows 15 in which appear the arms of the sliding stirrups associated with each of the switch elements. The surface to which the protective film can adhere is increased by the presence of the retaining element 14.

The embodiment of the switch according to the invention described with reference to FIGS. 1 and 2 provides in effect an eight-element interrupter switch.

However, making such switches with a greater or smaller number of elements according to the requirements can be envisaged.

In addition, thanks to the arrangement according to the invention, components other than interrupter switches, such as for example unipolar or bipolar reversing switches, can be constructed.

To make a unipolar reversing switch, it is sufficient to provide, in a common recess such as 2, a connection terminal 3 positioned at one end of the recess and two connection terminals 4 positioned at the opposite end of the recess, the said terminals 4 projecting into the bottom of the recess 7 at different lengths, such that when the stirrup 5 is in a first stable position corresponding to that represented in FIG. 3, one of the terminals 4 entering the recess, is connected to the terminal 3, whilst in the second position 4 of the stirrup 5, the two terminals 4 previously mentioned are connected together by the stirrup 5, whereas the terminal 3 is disconnected.

The eight-element switch represented in FIG. 1 lends itself particularly well to an advanced miniaturization because the area taken up by its components is equal to one third of the area of eight-element components at present available on the market.

The connection terminals 3 and 4 can for example be positioned at a standard pitch of 1.27 mm.

The eight-element switch according to the invention is particularly well adapted to surface mounting on printed circuit boards and, due to the outward curvature of its connection terminals, it allows visual checking of the soldering.

The curvature of the connection terminals towards the outside of the body of the switch allows a high-speed automatic introduction, and an assembly by soldering according to the various soldering processes used nowadays, namely wave soldering, refusion or infrared soldering and vapor phase soldering.

What is claimed:

1. An electric switch having a body of insulating material which contains at least one recess into which emerge first ends of at least two connection terminals second ends of which project outside said body and a switch mechanism comprising an electrically-conducting element fitted so as to slide in said recess between a first and second stable position, corresponding respectively to two states of the switch, characterized in that said electrically-conducting element comprises a stirrup having an elastic middle part which is substantially curved away from the bottom of said recess the ends of said middle part being in contact with said bottom and with said first ends of said connection terminals, and arms extending upwardly towards an opening of the recess in the body and appearing in windows defined by said opening on either side of an insulating element fixed to the body for retaining and elastically pressing said stirrup against the bottom of said recess by acting on said curved elastic middle part of said stirrup, said arms of said stirrup constituting the means for moving the latter between said first and second positions by action upon the ends of said arms through said windows.

2. Electric switch according to claim 1, characterized in that said element for retaining and elastically pressing the stirrup against the bottom of the recess comprises at least one axial rib designed to keep the curved middle part of said stirrup under slight stress.

3. Electric switch according to claim 2, characterized in that the element for retaining and pressing the stirrup against the bottom of the recess comprises two edges extending from the rib in the axial direction of the recess and under which the ends of the arms of the stirrup can in turn be concealed, only one of the arms of the stirrup being visible through the corresponding window at any one time and indicating the position of the switch.

4. Electric switch according to claim 1, characterized in that the end walls of the recess each define an end stop for the movement of the stirrup between the two stable positions of the switch.

5. Electric switch according to one of claims 1 to 4, characterized in that the body has several recesses of generally rectangular form, arranged side by side and extending crosswise to the longitudinal axis of said body, a stirrup-shaped element being arranged in each of said recesses and cooperating with corresponding connection terminals entering into the bottom of each recess, said stirrup-shaped elements being retained in their respective recesses by a common retaining and pressing element, fitted in to said body.

6. Electric switch according to claim 5, characterized in that the common retaining and pressing element has as many axial ribs as the body has recesses, each of the ribs cooperating with the elastic middle part of a corresponding stirrup.

7. Electric switch according to claim 6, characterized in that the recesses of said body are separated by walls with gaps in the middle which form a housing into which is fitted a common elastically retaining and pressing element having support elements depending therefrom separating said ribs and engaged in the gaps in the separating walls of the recesses.

8. Electric switch means according to claim 1, characterized in that said elastically retaining and pressing element has at least one fixing stem depending therefrom and engaged in a hole formed in the bottom of the body and emerging into an axial groove of the outer wall of the bottom, a head being formed at the end of said stem for securing the pressing and retaining element.

9. Electric switch according to claim 6, characterized in that the retaining and pressing element has a plurality of fixing stems evenly distributed along its length and depending from support elements said stems being engaged in holes formed in the bottom of the body.

10. An electric switch comprising a body of insulating material having at least one recess in which first ends of at least two connection terminals are disposed, second ends of said terminals projecting outside of said body, and having a switch mechanism slidable in said recess, an opening in an upper surface of said body communicating with said recess, and an insulating element inserted and fixed in said opening and closing at least a central portion of said opening and defining therewith windows on opposite sides of said insulating element, said switch mechanism comprising an electrically-conducting element having upwardly extending vertical arms and a central section joining the lower ends of said arms, said central section being resiliently bowed away from a bottom surface of said recess and said lower ends of said arms being in contact with said bottom surface, said insulating element having means for pressing against said bowed central section urging said electrically-conducting element toward said bottom surface, the upper ends of said arms being accessible through said windows for slidable actuation of said switch mechanism.

11. An electric switch according to claim 10 wherein said body has a plurality of parallel recesses arranged perpendicularly to the longitudinal axis of said body, each recess having associated terminals and switch mechanism, said opening in the upper surface of said body communicating with all of said recesses and said insulating element being longitudinally coextensive with said opening.

12. An electric switch according to claim 11 wherein said insulating element includes means extending into said body securing said element in place and holding said switch mechanism in said recesses under compression.

* * * * *